United States Patent [19]

Iwamoto et al.

[11] Patent Number: 4,938,274

[45] Date of Patent: Jul. 3, 1990

[54] METHOD OF DETECTING DEGASSED STATE IN MOLD AND SYSTEM THEREFOR

[75] Inventors: Norihiro Iwamoto; Hiroshi Iga, both of Zama, Japan

[73] Assignee: Toshiba Machine Co., Ltd., Tokyo, Japan

[21] Appl. No.: 281,071

[22] Filed: Dec. 8, 1988

[30] Foreign Application Priority Data

Dec. 10, 1987 [JP] Japan ..... 62-177256[U]
Aug. 31, 1988 [JP] Japan ..... 63-218053[U]

[51] Int. Cl.[5] ..... B22D 2/00; B22D 11/16

[52] U.S. Cl. ..... 164/4.1; 164/150; 164/305; 164/410; 164/457; 425/420; 425/812

[58] Field of Search ..... 164/4.1, 150, 154, 305, 164/410, 457; 425/420, 812

[56] References Cited

U.S. PATENT DOCUMENTS 4,838,338 6/1989 Priem ..... 164/305

FOREIGN PATENT DOCUMENTS 3505554 8/1986 Fed. Rep. of Germany ..... 164/457
209535 12/1983 Japan ..... 425/812
61-209761 9/1986 Japan .
209761 9/1986 Japan ..... 164/457
2101360 5/1987 Japan ..... 164/305
180354 7/1988 Japan ..... 164/305

*Primary Examiner*—Nicholas P. Godici
*Assistant Examiner*—Edward Brown
*Attorney, Agent, or Firm*—Cushman, Darby & Cushman

[57] ABSTRACT

The present invention relates to a method of detecting a degassed state in a mold and a system therefor. A gas release opening is formed between a movable mold part and stationary mold part, and a diffuser block having a path for releasing the gas to atmosphere is disposed on the mold. A secondary flow path capable of generating a secondary flow when the gas is released is formed in this diffuser block, and a wind velocity sensor is disposed in this path. Wind velocities of the secondary flow, which are detected by the wind velocity sensor, serve as indications of a cast state and the like in a die cast machine or the like. The secondary flow path is suitably shut off by a shut-off mechanism, and connected to an air cleaner, so that the wind velocity sensor can be effectively protected from dust and the like.

15 Claims, 9 Drawing Sheets

METHOD OF DETECTING DEGASSED STATE IN MOLD AND SYSTEM THEREFOR

BACKGROUND OF THE INVENTION

1. Field of the Invention

This invention relates to a method of detecting a degassed state in a mold, which serves as an indication of a cast state in a die cast machine, a molded state in an injection molding machine or the like, and a system therefor.

2. Description of the Related Art

With a die cast machine, an injection molding machine or the like, in injecting molten metal or a molten resin material into a mold, there is provided a means for releasing a gas from the mold. The reason is that, due to the presence of the gas in the mold, pressure acting on the molten metal or the like becomes unsatisfactory, with the result that many defects occur.

With the above-described techniques as a background, in Japanese Patent Publication No. "Kokai" 61-209761, there has been proposed a method of detecting a gas blow-out state from a mold by means of a sensor and effecting casting control of a die cast machine based on the detected result.

According to this method, a sensor is provided at a release opening of a degassing passage communicating with the cavity of the mold, a diaphragm in the sensor is arranged to be displaced in response to the release of the gas from the release opening, and a degassed state is detected from a displacement value of the diaphragm.

However, the method in the Patent Publication No. "Kokai" 61-209761 suffers from the problem that the manufacturing cost is high because a sensor sensitive to a very small change in pressure is used.

Moreover, the method suffers from the problems that, since the sensor is exposed to the outside of the mold, the sensor is impaired in its function by dust and the like contained in the ambient atmosphere around the sensor, which becomes a cause of lowered measuring accuracy, so that the sensor is low in reliability after use for a long period of time.

SUMMARY OF THE INVENTION

The present invention has been developed to obviate the above-described problems of the related art and has as its object the provision of a method of detecting a degassed state for die casting, being reduced in manufacturing cost and avoiding a cause of lowered measuring accuracy of a sensor and capable of withstanding use for a long period of time, and a system therefor.

The method of detecting a degassed state in a mold according to the present invention features that, in injecting a molten material into the mold to mold the material into a predetermined form, the gas in the mold is adapted to be released through a degassing vent and a gas release opening communicated with the degassing vent, a diffuser section serving as a path for allowing a released gas jet stream to flow therethrough is provided on an extension of the gas release opening, at least one secondary flow path communicated with this diffuser section is formed, and a wind velocity sensor is provided in this secondary flow path to sense the secondary flow generated in the secondary flow path when the gas is blown out.

The system for detecting a degassed state in a mold according to the present invention comprises: a degassing vent and a gas release opening communicated therewith, both of which release the gas in the mold, when a molten material is injected into the mold to be molded into a predetermined form; a diffuser section formed on an extension of this gas release opening, for serving as a path for a released gas stream; at least one secondary flow path communicated with this diffuser section; and a wind velocity sensor provided in this secondary flow path, for sensing a secondary flow adapted to occur in the secondary flow path when the gas is blown out.

With the above-described arrangement according to the present invention, when a molding material such as a molten metal is injected into the mold, the gas in the mold is released through the gas release opening and the diffuser section to the outside. At this time, a secondary flow due to the ejector action accompanied by the gas release occurs in the secondary flow path communicated with the diffuser section. This secondary flow is detected by the wind velocity sensor disposed in the secondary flow path, so that a degassed state in the mold, which serves as indications of a cast state in the die cast machine, a molded state in the injection molding machine or the like can be detected with high accuracy.

DETAILED DESCRIPTION OF THE PREFERRED EMBODIMENTS

Figure 1:
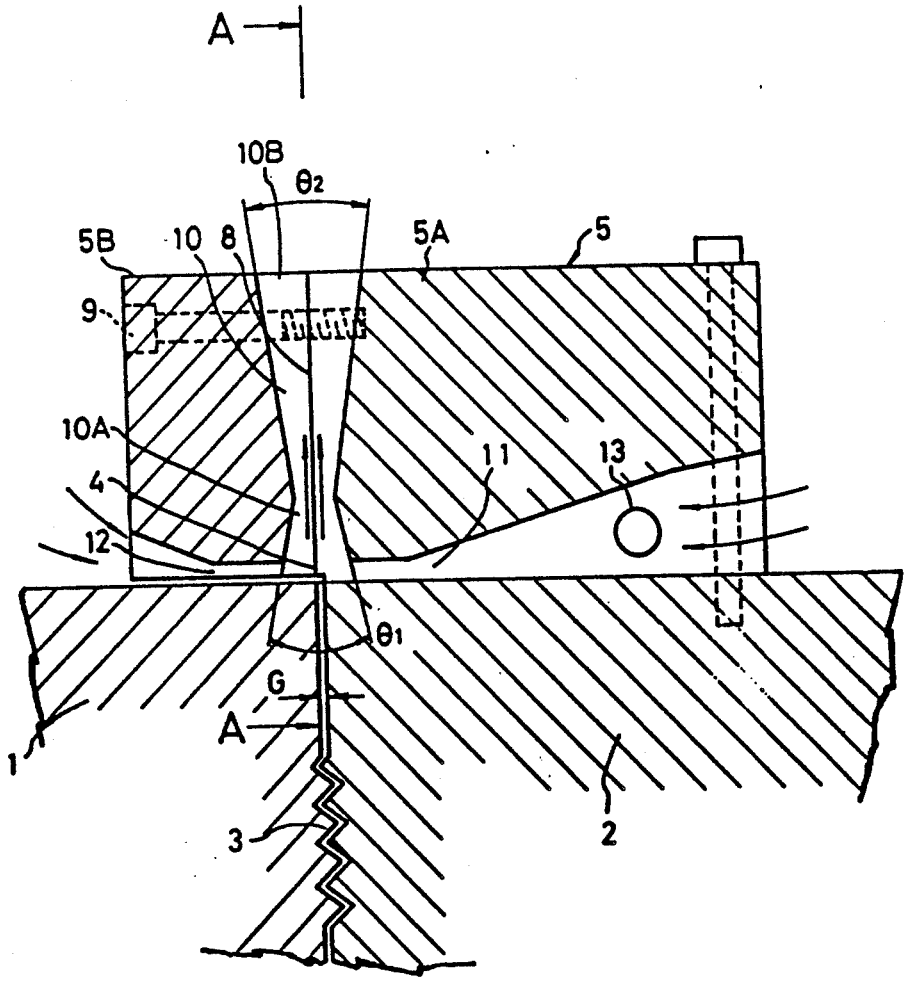
FIG. 1 is a sectional view showing a first embodiment of the present invention.
Figure 2:
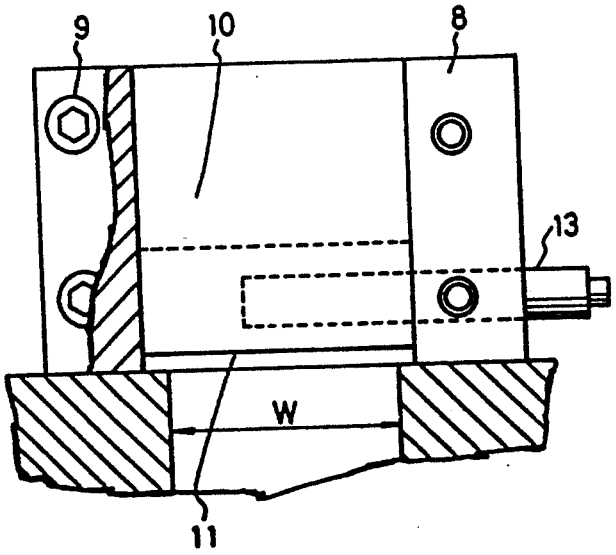
FIG. 2 is a sectional view taken along the line A—A in FIG. 1.
Figure 3:
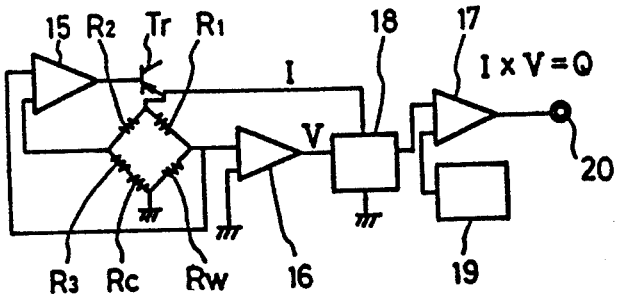
FIG. 3 is a block diagram showing the wind velocity sensor.

The embodiments of the present invention will hereunder be described with reference to the accompanying drawings. FIGS. 1 to 3 show the first embodiment of the present invention. Referring to FIG. 1 showing the general arrangement, a degassing vent 3 communicated with a mold cavity, not shown, is provided between a movable mold part 1 and a stationary mold part 2. This degassing vent 3 is partially formed into a zigzag shape, and a section thereof from the intermediate portion to a gas release opening is formed to provide a slit shape having a clearance G and a width W (Refer to FIG. 2).

A diffuser block 5 is disposed on the stationary mold part 2. This diffuser block 5 includes a first block 5A fixed to the stationary mold part 2 and a second block 5B provided to the left of this first block 5A in FIG. 1. The second block 5B is fixed to the first block 5A through a bolt 9 in such a state that joint end faces 8 of these blocks 5A and 5B are in abutting contact with each other. A diffuser section 10 communicated with the gas release opening 4 is formed in a state where the first and second blocks 5A and 5B are joined together. This diffuser section 10 is partially constricted in the state where the joint end faces 8 formed respectively on the first and second blocks 5A and 5B, that is, in the state illustrated, and constituted by a first diffuser section 10A formed between this constricted portion and the gas release opening 4, having an angle $\theta_1$ progressively flaring toward the release opening 4 and a second diffuser section 10B formed on the side opposite to this first diffuser section 10A, having an angle $\theta_2$ progressively flaring outwardly. Accordingly, the gas in the mold is released to atmosphere through the degassing vent 3, the gas release opening 4 and the diffuser section 10. First and second secondary flow paths 11 and 12, which are communicated with the first diffuser section 10A of the diffuser section 10, are provided at both the right and left sides of the first diffuser section 10A in the drawing as opposed to each other. Furthermore, a wind velocity sensor 13 is disposed in the secondary flow path 11. This wind velocity sensor 13 is adapted to measure the wind velocity of the secondary flow occurring in the secondary flow path 11 due to the ejector action caused when the gas in the mold is released to atmosphere, so that the degassed state in the mold can be sensed to serve as the indications of the cast state and the like. As this wind velocity sensor 13, the well-known hot-wire wind velocity sensor is used, the arrangement of which is shown in FIG. 3.

In FIG. 3, designated at Rw is a platinum hot wire and Rc is a temperature compensation wire, the both of which form a bridge circuit in cooperation with resistors $R_1$–$R_3$. Denoted at I is a current flowing through the platinum hot wire Rw, V a voltage at a both ends of the platinum hot wire, 15–17 amplifiers, Tr a transistor, 18 a multiplier of IC, and 19 a zero point compensation device, whereby an output as being the secondary flow can be obtained in 20.

Action of this embodiment will hereunder be described.

First, as shown in FIG. 1, a state where the movable mold part 1 and the stationary mold part 2 are clamped together is brought about. In this state, the diffuser section 10 is disposed o the extension of the gas release opening 4.

Now, when the molten metal is injected into the mold cavity, not shown, the gas in the cavity is blown out to atmosphere due to the injection pressure of the molten metal through the degassing vent 3, the release opening 4 and the diffuser section 10. Simultaneously with this, air tends to flow from the secondary flow paths 11 and 12 toward the diffuser section 10 due to the ejector action accompanied by the gas release, and a wind velocity at this time is detected by the wind velocity sensor 13.

Accordingly, in the above-described embodiment, the first and second flow paths 11 and 12 are formed in the diffuser block 5 and the wind velocity sensor 13 not being exposed to the outside is disposed in the first secondary path 11, so that the adverse effect exerted onto the wind velocity sensor 13 can be reduced and the cause of lowered measuring accuracy can be minimized, thus advantageously enabling to place the reliability on the measured results as being the indications of the cast state. The wind velocity sensor 13 is not exposed to the outside, so that the damaging of the sensor 13 due to the contact with the related components and the like can be avoided.

Further, the wind velocity sensor 13 is arranged to use the well-known sensor, not using the diaphragm exemplified as in the conventional technique, so that manufacturing cost can be reduced.

Figure 5:
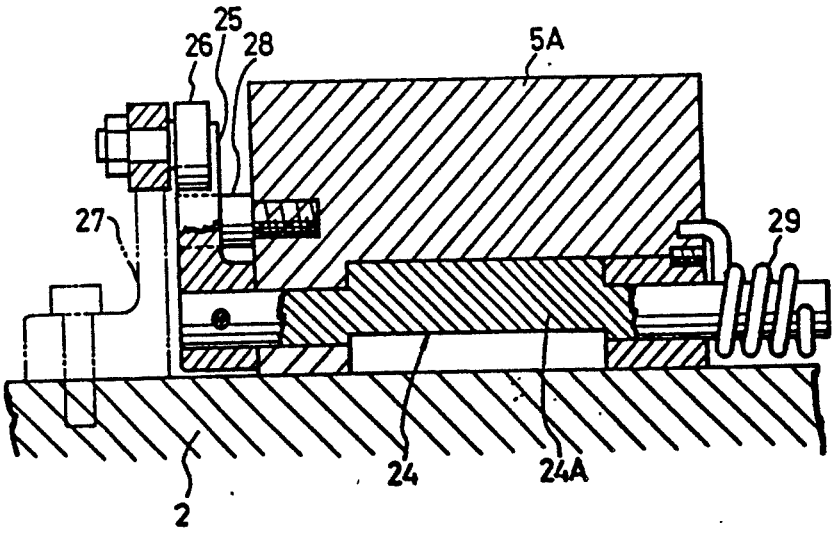
FIG. 5 is a sectional view taken along the line C—C in FIG. 4.
Figure 6A:
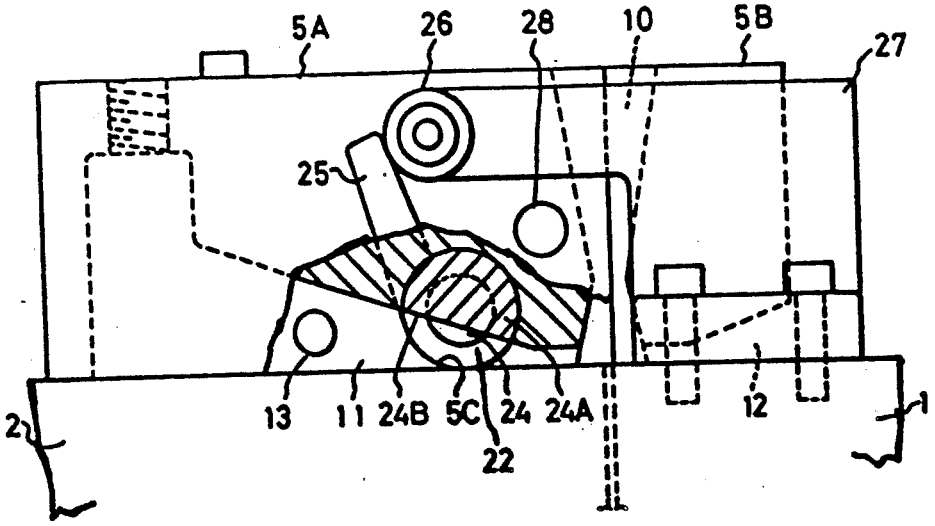
FIG. 6(A) and 6(B) are partially sectional views of the system shown in FIG. 4, a mold clamped state and a mold opened state of which are viewed from the rear surface side.
Figure 6:
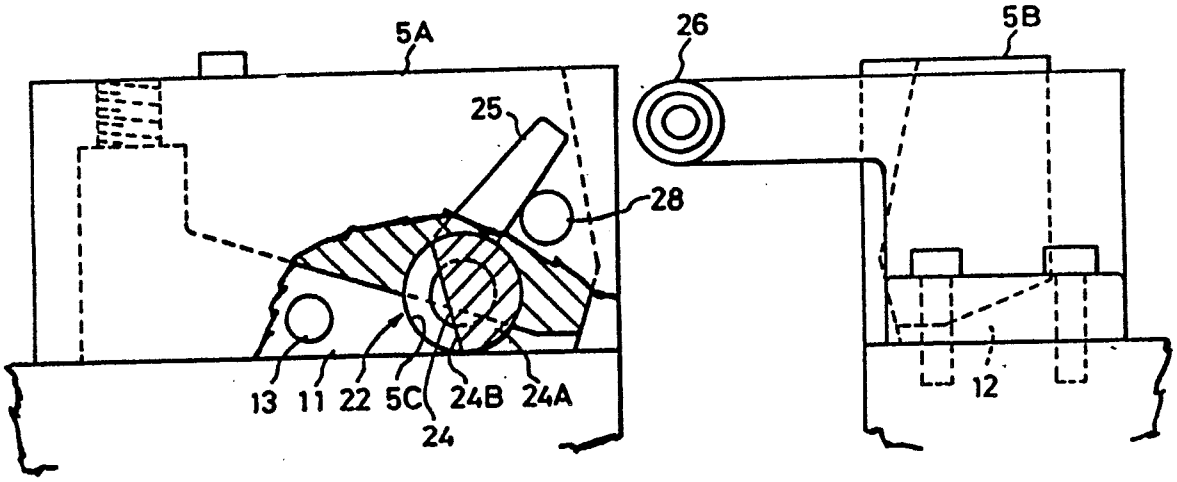

The second embodiment of the present invention will hereunder be described with reference to FIGS. 4 to 6. Same reference numerals are used to designate same or similar parts and arrangements corresponding to ones as shown in the first embodiment, so that the description need not be repeated or is simplified.

This second embodiment is different from the first embodiment in that a shut-off mechanism 22 is provided for making the first flow path 11 openable or closable and air supplied to this first secondary flow path 11 is fed from an air cleaner 23.

Figure 4:
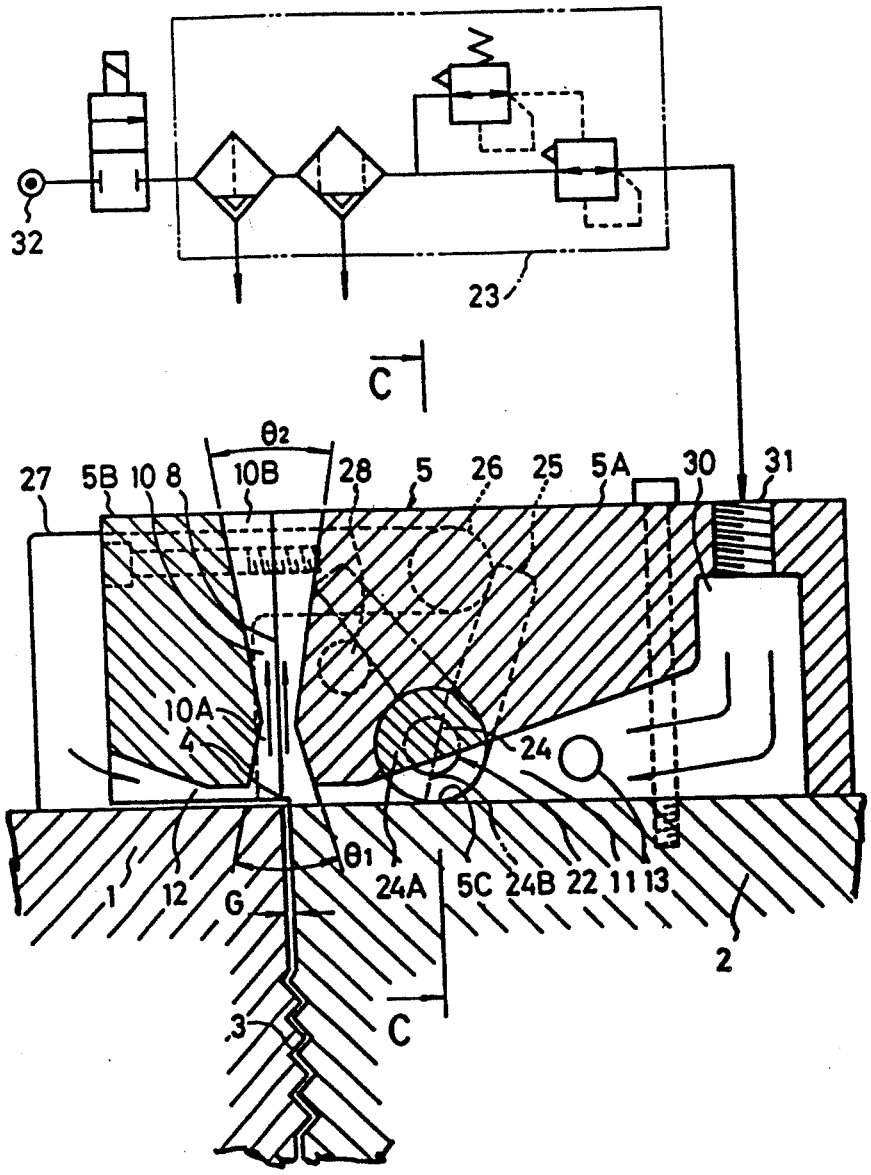
FIG. 4 is a sectional view showing a second embodiment of the present invention.

The shut-off mechanism 22 functions such that the secondary flow can be generated in the first flow path 11 while the movable mold part 1 and the stationary mold part 2 are clamped together, to thereby bring the secondary flow into contact with the wind velocity sensor 13, and comprises: a rotary shaft 24 rotatably inserted and supported in a hole 5C formed in the first block 5A in a direction perpendicular to the paper surface in FIG. 4; a lever 25 fixed to one end of this rotary shaft 24; a cam follower 26 engageable with this lever 25; and a support member 27 for supporting this cam follower 26. As shown in FIGS. 6(A) and 6(B), this support member 27 is fixed onto the movable mold part 1, adapted to move integrally with the movable mold part 1 as the movable mold part 1 moves in the direction of mold clamping or mold opening, whereby the lever 25 engaged with the cam follower 26 supported by the support member 27 is rocked to thereby rotate the rotary shaft 24. As shown in FIGS. 4 to 6, the rotary shaft 24 has a central portion 24A being of a substantially semi-cylindrical shape in cross section, to thereby form a flat surface portion 24B. With this arrangement, when the lever 25 is rocked to rotate the rotary shaft 24, the flat surface portion 24B can shut off the air flow to the diffuser section 10 through the first secondary flow path 11. In this case, the shut-off mechanism 22 is in the opened state while the mold is clamped, and in the closed state when the mold is opened.

The lever 25 is regulated in its range of rocking by a stopper 28 fixed to the first block 5A. The lever 25 is normally biased toward the stopper 28 through the agency of a torsional spring 29 (Refer to FIG. 5) provided at one end of the rotary shaft 24.

Further, an air chamber 30 is defined at the upstream side of the first flow path 11, that is, to the right in FIG. 4, and the air cleaner 23 is connected to a port 31 of this air chamber 30. This air cleaner 23 is a well-known device including a micron filter, a mist separator, a drier and the like, and set at a very low pressure by means of an air pressure source 32. The other arrangements are substantially the same as in the first embodiment.

Action of the second embodiment will hereunder be described.

In the state where the movable mold part 1 and the stationary mold part 2 are clamped together, the diffuser section 10 is disposed on the extension of the gas release opening 4, and the lever 25 forming the shut-off mechanism 22 is brought into contact with the cam follower 26 supported by the support member 27 to be moved to a position shown in FIG. 6(A) against the biasing force of the torsional spring 29. With this operation, the flat surface portion 24B of the central portion 24A of the rotary shaft 24 is similarly rotated to a position shown in FIG. 6(A), whereby such a state is brought about that air can flow into the diffuser section 10 through the first flow path 11.

Now, when the molding material such as the molten metal or a molten resin material is injected into the mold cavity, not shown, the gas in the cavity is blown out to atmosphere similarly to the first embodiment. Simultaneously with this, air tends to flow into the diffuser section 10 through the secondary flow paths 11 and 12 due to the ejector action accompanied by the blow-out of the gas. In this case, the air flowing through the first flow path 11 is fed from the air cleaner 23, so that lowered measuring accuracy of the wind velocity sensor 13 resulting from dust and the like can be avoided.

Accordingly, in the second embodiment, the first flow path 11 is arranged such that the secondary flow is produced by the shut-off mechanism 22 while the mold is clamped, and the secondary flow is prevented from occurring while the mold is opened, so that such an advantage can be added that the wind velocity sensor can be protected more reliably. The air fed into the first flow path 11 is supplied from the air cleaner 23, whereby impurities such as dust which are contained in the air are removed, so that adverse effects exerted onto the wind velocity sensor 13 can be swept away, thus offering the advantages that the wind velocity sensor 13 can be used for a long period of time and the stabilized detection can be expected from this respect. In other words, the measuring accuracy can be maintained constant at all times, so that the high reliability can be placed on the measured results as the indication of the molded state.

Figure 7:
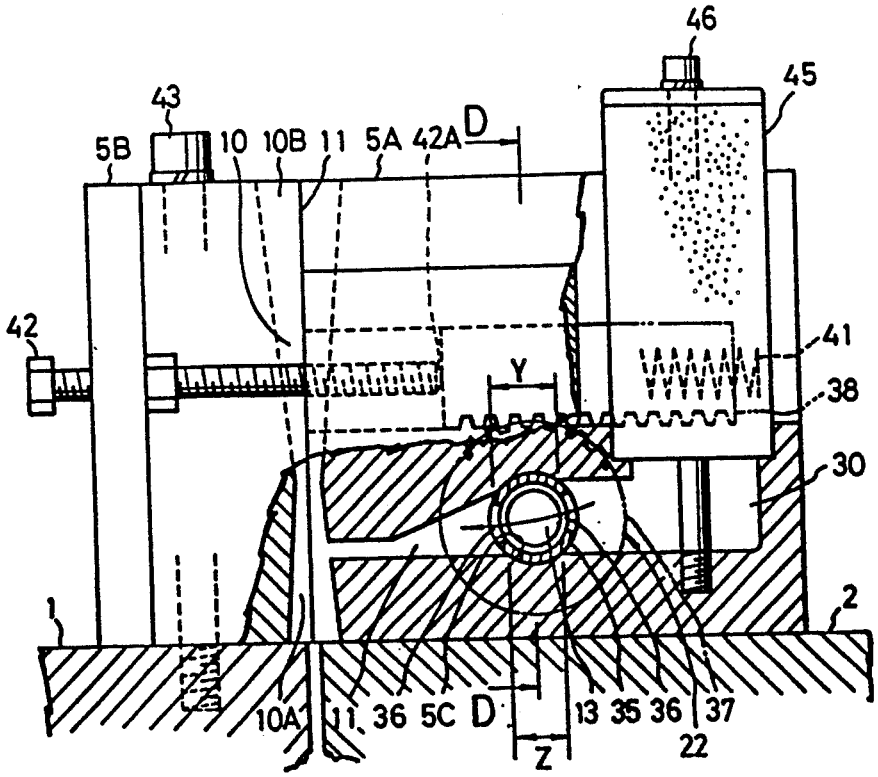
FIG. 7 is a partially sectional view showing a third embodiment of the present invention.
Figure 8:
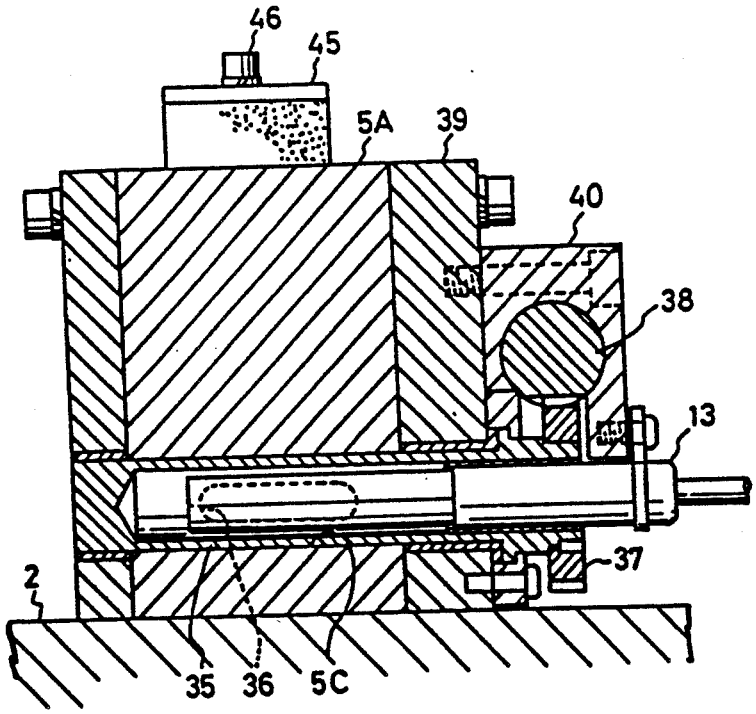
FIG. 8 is a sectional view taken along the line D—D in FIG. 7.

The third embodiment of the present invention will hereunder be described with reference to FIGS. 7 and 8. In this description of the third embodiment, same reference numerals are used to designate same or similar parts and arrangements corresponding to ones as shown in the first and second embodiments, so that the description need not be repeated or is simplified.

The third embodiment features that the rotary shaft 24 constituting the shut-off mechanism 22 in the second embodiment is replaced by a hollow rotary pipe 35, in which the wind velocity sensor 13 is disposed, this rotary pipe 35 is rotated by a rack-pinion driving system, the air cleaner 23 in the second embodiment is replaced by an air filter 45 which is faced to the secondary flow path 11, and further, the secondary flow path 11 is formed at one place, so that the structure is simplified.

More specifically, vent holes 36 are penetrated in the diametral direction through the peripheral wall portion of the rotary pipe 35, and a pinion 37 is fixed to one side of the rotary pipe 35. This pinion 37 is engaged with a rack 38, whereby the rotary pipe 35 is rotated by the linear movement of this rack 38. The rack 38 is axially movably held in a holding block 40 fixed to the first block 5A through a block 39. As shown in FIG. 7, the rack 38 is normally biased to the left by a spring 41 and in abutting contact with the forward end 42A of a push bolt 42 supported by the second block 5B on the side opposite to this spring 41. In this case, the second block 5B, differing from the one in the first and second embodiments, is fixed to the movable mold part 1 through a bolt 43, whereby the rack 38 is moved to the right in FIG. 7 while the mold is clamped, and moved to the left by the biasing force of the spring 41 while the mold is opened. Accordingly, while the mold is clamped, the vent holes 36 are located at positions shown in FIG. 7 to allow the secondary flow to occur in the secondary flow path 11, whereas, while the mold is opened, the vent holes 36 are located at positions Y and Z of the hole 5C, respectively, to prevent the secondary flow from occurring.

In the air chamber 30 of the secondary flow path 11, an air filter 45 is fixed thereto through a bolt 46 being faced to the air chamber 30.

With the third embodiment as described above, substantially the same advantages as in the first and second embodiments are obtainable. The rotary pipe 35 is used in the shut-off mechanism 14, the vent holes 36 are formed in the rotary pipe 35 and the rotary pipe 35 is driven by the rack-pinion system, thus offering the advantage that rotation of the rotary pipe 35 can be effected more accurately.

The secondary flow path 11 is formed only in the first block 5A constituting the diffuser block 5, so that the block is simplified in structure. Further, the air cleaner 23 in the second embodiment is replaced by the air filter 45, so that simplified structure can be achieved easily from this respect.

In the description of the above embodiment, the position at which the secondary flow paths 11, 12 and the diffuser section 10 are intercommunicated is not limited to the example of illustrated arrangement, and a release opening of the secondary flow path may be faced to the constricted portion of the diffuser section 10 for example.

The flaring angles $\theta_1$ and $\theta_2$ may be desirably selected a design.

Further, the shut-off mechanism 22 need not necessarily be limited to the mechanical arrangement in the illustrated example, and, it suffices only if such an arrangement is adopted that occurrence of the secondary flow in the secondary flow path 11 can be suitably shut off. Any arrangement using a cylinder, electric driving or the like may be adopted.

As has been described hereinabove, the present invention can offer the advantages of providing the method of detecting the degassed state, being reduced in manufacturing cost and avoiding the cause of lowered measuring accuracy of the sensor and capable of withstanding use for a long period of time, and the system therefor.

What is claimed is:

1. A method of detecting a degassed state in a mold, comprising the steps of:

injecting a molten material into the mold to mold said material into a predetermined form, the mold being adapted to release gas through a degassing vent and a gas release opening communicating therewith, a diffuser section serving as a path for allowing a released gas jet stream to flow therethrough being provided as an extension of said gas release opening on the exterior of the mold, at least one secondary flow path communicating with said diffuser section being formed adjacent to the mold, and sensing, using a wind velocity sensor provided in said secondary flow path, the secondary flow generated in said secondary flow path when the gas is released from the mold.

2. A method of detecting a degassed state in a mold as set forth in claim 1, wherein, in said secondary flow path, no secondary flow is generated while the mold is opened.

3. A method of detecting a degassed state in a mold as set forth in claim 1, wherein fresh air is supplied to said secondary flow path.

4. A method of detecting a degassed state in a mold as set forth in claim 1, wherein said secondary flow path is controlled such that said secondary flow can be generated in synchronism with opening or clamping of the mold.

5. A system for detecting a degassed state in a mold, comprising:

a degassing vent and a gas release opening communicating therewith, both of which release gas in the mold, when a molten material is injected into the mold to be molded into a predetermined form;

a diffuser section formed as an extension of said gas release opening on the exterior of the mold, serving as a path for a release gas stream;

at least one secondary flow path adjacent to the mold communicating with said diffuser section; and a wind velocity sensor provided in said secondary flow path adapted to sensing a secondary flow occurring in said secondary flow path whenever said gas is released from the mold.

6. A system for detecting a degassed state in a mold as set forth in claim 5, wherein a shut-off mechanism is provided for shutting the atmospheric air off said wind velocity sensor, whereby the secondary flow is brought into contact with said wind velocity sensor while the mold is clamped.

7. A system for detecting a degassed state in a mold as set forth in claim 6, wherein said shut-off mechanism is arranged such that said mechanism includes a rotary shaft rotatably supported in a block constituting said diffuser section and rotation of said rotary shaft suitably shuts off the air flow from the secondary flow path into said diffuser section.

8. A system for detecting a degassed state in a mold as set forth in claim 7, wherein said rotary shaft is rotated in synchronism with opening or clamping of the mold.

9. A system for detecting a degassed state in a mold as set forth in claim 6, wherein said shut-off mechanism is arranged such that said mechanism includes a rotary pipe rotatably supported in a block constituting said diffuser section, holes are formed in said rotary pipe in the diametral direction thereof, and, suitable changed positions of said holes make it possible to suitably shut off the air flow from the secondary flow path into the diffuser section.

10. A system for detecting a degassed state in a mold as set forth in claim 9, wherein said rotary pipe is rotated in synchronism with opening or clamping of the mold.

11. A system for detecting a degassed state in a mold as set forth in claim 10, wherein said rotary pipe is connected thereto with a pinion, which is engaged with a rack linearly movable by the movement of the mold.

12. A system for detecting a degassed state in a mold as set forth in claim 5, wherein means for supplying fresh air is connected to an air chamber of said secondary flow path.

13. A system for detecting a degassed state in a mold as set forth in claim 12, wherein said fresh air supplying means is an air filter.

14. A method of detecting a degassed state in a mold, comprising the steps of:

injecting a molten material into the mold such that said material can be molded into a predetermined form, the mold being adapted to release gas through a degassing vent and a gas release opening communicated therewith, a diffuser section serving as a path for allowing a released gas jet stream to flow therethrough is provided as an extension of said gas release opening on the exterior of the mold, at least one second flow path in communication with said diffuser section being formed adjacent to the mold;

sensing, using a wind velocity sensor provided in said secondary flow path, the secondary flow generated in said secondary flow path when the gas is released from the mold, and shutting the atmospheric air off said wind velocity sensor, whereby the secondary flow is brought into contact with said wind velocity sensor while the mold is clamped.

15. A system for detecting a degassed state in a mold, comprising:

a degassing vent and a gas release opening communicating therewith, both of which release the gas in the mold, when a molten material is injected into the mold to be molded into a predetermined form;

a diffuser section formed as an extension of said gas release opening on the exterior of the mold, serving as a path for a released gas stream;

at least one secondary flow path communicating with said diffuser section;

a wind velocity sensor provided in said secondary flow path adapted to sense a secondary flow in said secondary flow path when the gas is released from the mold; and a shut-off means for shutting the atmospheric air off said wind velocity sensor, whereby the secondary flow is brought into contact with said wind velocity sensor while the mold is clamped.

* * * * *

UNITED STATES PATENT AND TRADEMARK OFFICE

CERTIFICATE OF CORRECTION

PATENT NO. : 4,938,274

DATED : July 3, 1990

INVENTOR(S) : Iwamoto, Norihiro and Iga, Hiroshi

It is certified that error appears in the above-identified patent and that said Letters Patent is hereby corrected as shown below:

ON TITLE PAGE:

Please Change:

"(30) Foreign Application Priority Data

Dec. 10, 1987 (JP) Japan . . . . . 62-177256(U)"

to

--(30) Foreign Application Priority Data

Dec. 10, 1987 (JP) Japan . . . . . 62-188256(U)--

Signed and Sealed this

Third Day of December, 1991

*Attest:*

HARRY F. MANBECK, JR.

*Attesting Officer*

*Commissioner of Patents and Trademarks*